US011224261B2

(12) United States Patent
Mariscal et al.

(10) Patent No.: US 11,224,261 B2
(45) Date of Patent: Jan. 18, 2022

(54) KNITTED ARTICLE WITH AT LEAST ONE SCALLOP ELEMENT AND METHODS OF MANUFACTURE

(71) Applicant: NIKE, Inc., Beaverton, OR (US)

(72) Inventors: JoseLuis Mariscal, Portland, OR (US); Roberto Zavala, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/429,945

(22) Filed: Feb. 10, 2017

(65) Prior Publication Data

US 2018/0228241 A1 Aug. 16, 2018

(51) Int. Cl.

| | |
|---|---|
| ***A43B 1/04*** | (2006.01) |
| ***D04B 21/20*** | (2006.01) |
| ***D04B 1/22*** | (2006.01) |
| ***A43B 23/26*** | (2006.01) |
| ***A43B 23/02*** | (2006.01) |
| ***A43B 23/04*** | (2006.01) |

(52) U.S. Cl.

CPC ..... *A43B 1/04* (2013.01); *A43B 23/027* (2013.01); *A43B 23/028* (2013.01); *A43B 23/0265* (2013.01); *A43B 23/0275* (2013.01); *A43B 23/04* (2013.01); *A43B 23/26* (2013.01); *D04B 1/22* (2013.01); *D04B 21/207* (2013.01); *D10B 2403/0113* (2013.01); *D10B 2403/032* (2013.01); *D10B 2501/043* (2013.01)

(58) Field of Classification Search

CPC ..... A43B 1/04; A43B 23/028; A43B 23/0275; A43B 23/26; A43B 23/027; A43B 23/0265; A43B 23/024; D04B 1/225; D04B 21/207; A41B 11/001; A41B 11/006; A43C 7/02

See application file for complete search history.

(56) References Cited

U.S. PATENT DOCUMENTS 2,814,807 A * 12/1957 Dollar ..... A41B 11/006 2/239
5,335,613 A * 8/1994 Glenn ..... D05B 35/06 112/412

(Continued)

FOREIGN PATENT DOCUMENTS

CN 105476181 A 10/2015
CN 205255669 U 5/2016

(Continued)

OTHER PUBLICATIONS

International Preliminary Report on Patentability in Application No. PCT/US2018/017246, dated Aug. 22, 2019, 13 pages.

(Continued)

*Primary Examiner* — Katharine G Kane

(74) *Attorney, Agent, or Firm* — Shook, Hardy & Bacon LLP

(57) ABSTRACT

In one aspect, the present disclosure relates to an article at least partially formed by a knitted component. In some embodiments, the article may include an upper for an article of footwear. The knitted component may include a seamless portion extending from a toe area, through a midfoot area, and to a heel area of the upper on at least one of a lateral and a medial side of the upper. A first course may at least partially form the knitted component, and the first course may extend from the heel area to the toe area of the upper.

14 Claims, 6 Drawing Sheets

(56) References Cited

U.S. PATENT DOCUMENTS

| | | | | |
|---|---|---|---|---|
| 5,503,210 | A * | 4/1996 | Colson | E06B 9/40 160/84.05 |
| 6,910,288 | B2 | 6/2005 | Dua | |
| 7,814,598 | B2 | 10/2010 | Dua et al. | |
| 8,490,299 | B2 | 7/2013 | Dua et al. | |
| 8,595,878 | B2 | 12/2013 | Huffa et al. | |
| 8,839,532 | B2 | 9/2014 | Huffa et al. | |
| 8,959,800 | B2 | 2/2015 | Sokolowski et al. | |
| 9,010,157 | B1 | 4/2015 | Podhajny | |
| 9,078,488 | B1 * | 7/2015 | Meir | A43B 1/04 |
| 9,095,186 | B2 | 8/2015 | Follet | |
| 9,192,204 | B1 * | 11/2015 | Liles | A43C 1/04 |
| 9,351,532 | B2 | 5/2016 | Mokos | |
| 9,420,850 | B2 | 8/2016 | Dojan et al. | |
| 9,538,803 | B2 | 1/2017 | Bell et al. | |
| 9,622,536 | B2 | 4/2017 | Woodman et al. | |
| 9,681,704 | B2 | 6/2017 | Podhajny et al. | |
| 9,730,484 | B2 | 8/2017 | Dua et al. | |
| 9,745,677 | B2 | 8/2017 | Dua et al. | |
| 2007/0256267 | A1 * | 11/2007 | Burnett | A47L 13/20 15/229.1 |
| 2008/0110049 | A1 * | 5/2008 | Sokolowski | A43B 1/04 36/50.1 |
| 2011/0078921 | A1 * | 4/2011 | Greene | A43B 1/04 36/47 |
| 2013/0305561 | A1 * | 11/2013 | Clinton | A43C 19/00 36/1.5 |
| 2013/0340484 | A1 * | 12/2013 | Turner | B41F 15/18 66/171 |
| 2014/0137433 | A1 * | 5/2014 | Craig | A43B 1/04 36/50.1 |
| 2014/0137434 | A1 * | 5/2014 | Craig | A43B 1/04 36/54 |
| 2014/0150296 | A1 | 6/2014 | Dua et al. | |
| 2014/0373389 | A1 | 12/2014 | Bruce | |
| 2015/0059210 | A1 * | 3/2015 | Droege | A43B 23/0235 36/84 |
| 2015/0342285 | A1 * | 12/2015 | Huffman | A43B 23/024 36/9 R |
| 2015/0342286 | A1 * | 12/2015 | Huffman | A43B 1/04 36/9 R |
| 2016/0058099 | A1 * | 3/2016 | Panian | A43B 23/0265 36/84 |
| 2016/0058100 | A1 * | 3/2016 | Dealey | A43B 1/04 36/84 |
| 2016/0081417 | A1 | 3/2016 | Podhajny | |
| 2016/0088893 | A1 * | 3/2016 | Meir | A43B 1/04 36/84 |
| 2016/0166000 | A1 * | 6/2016 | Bruce | A43B 1/04 12/142 G |
| 2016/0208421 | A1 * | 7/2016 | Baines | A43B 1/04 |
| 2016/0302524 | A1 * | 10/2016 | Smith | A43B 13/12 |
| 2016/0366980 | A1 * | 12/2016 | Bell | A43C 1/04 |

FOREIGN PATENT DOCUMENTS

| | | | |
|---|---|---|---|
| CN | 205757510 | U | 12/2016 |
| CN | 104106882 | B | 7/2017 |
| DE | 202015101672 | | 5/2015 |
| EP | 2792265 | A2 | 10/2014 |
| EP | 2987897 | A1 | 2/2016 |
| TW | M464032 | | 11/2013 |
| TW | M493278 | | 1/2015 |
| TW | M531760 | | 11/2016 |
| TW | I592102 | | 7/2017 |
| WO | WO 2016/053808 | A1 | 4/2016 |

OTHER PUBLICATIONS

Search Report in Taiwan Application No. 107104817, dated Dec. 30, 2019, 5 pages.

Office Action in Chinese Application No. 2018800109034, dated Jun. 22, 2020,(14 pages).

* cited by examiner

FIG. 2
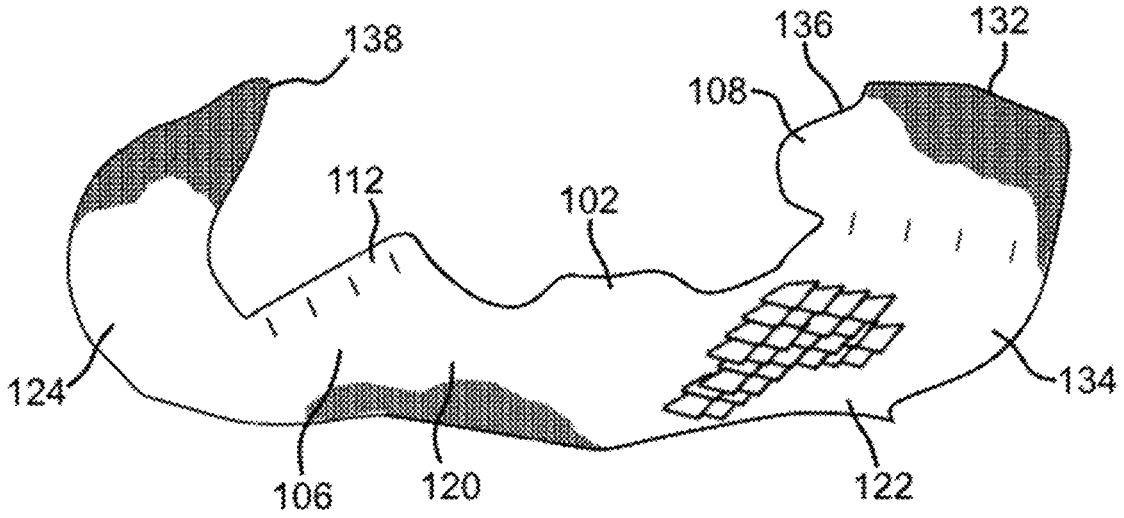
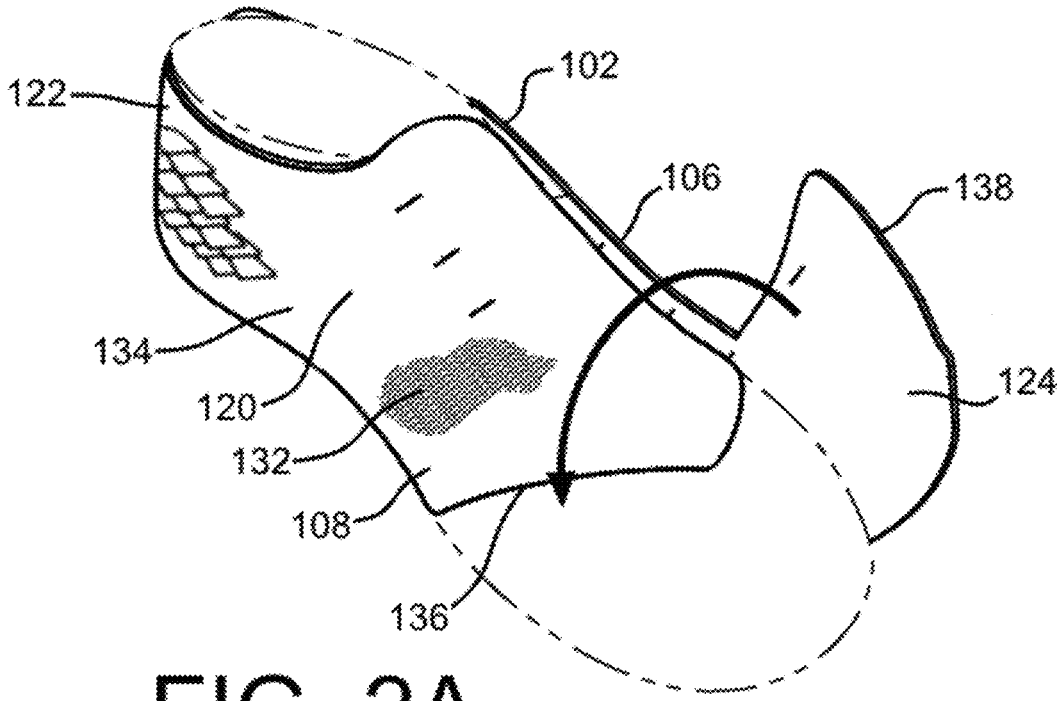
FIG. 2A

FIG. 3
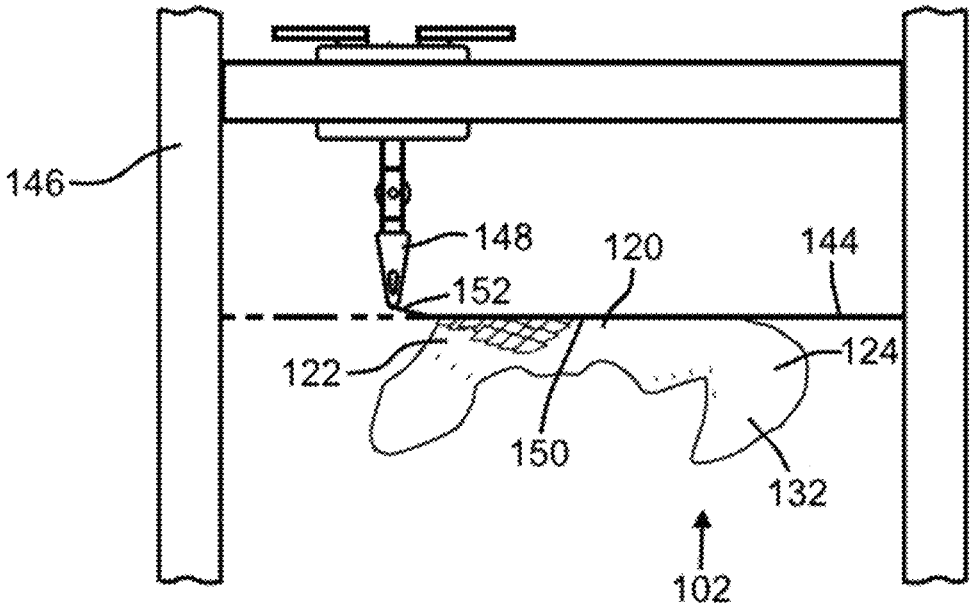
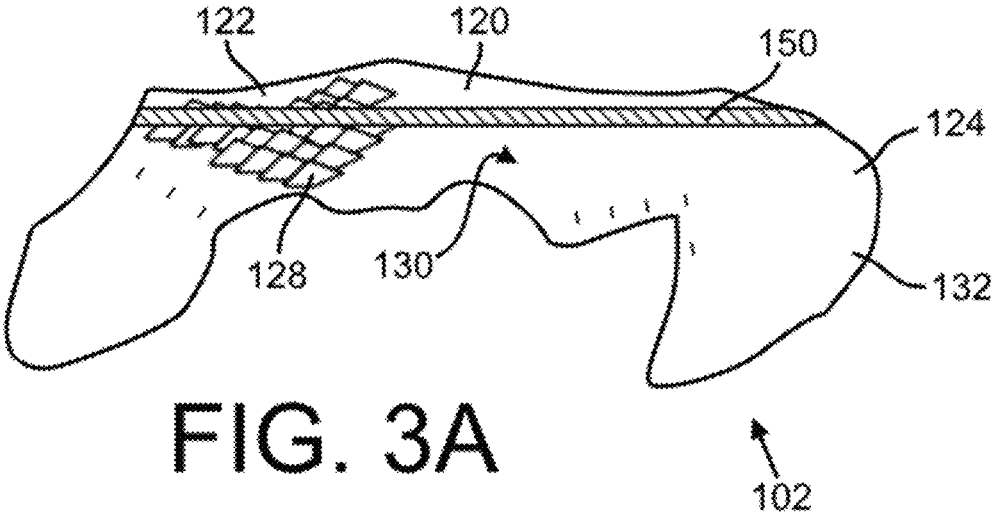
FIG. 3A

FIG. 4A
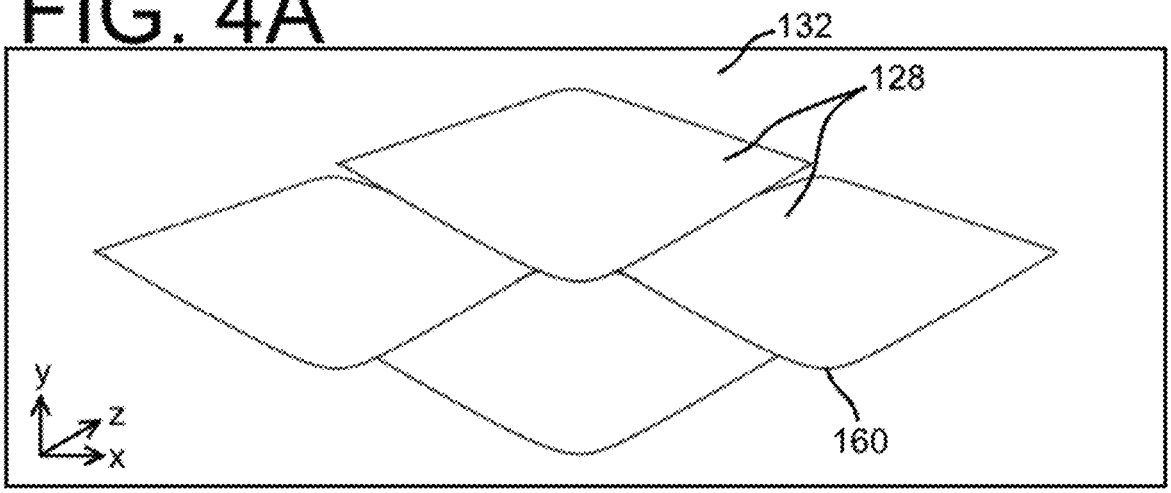
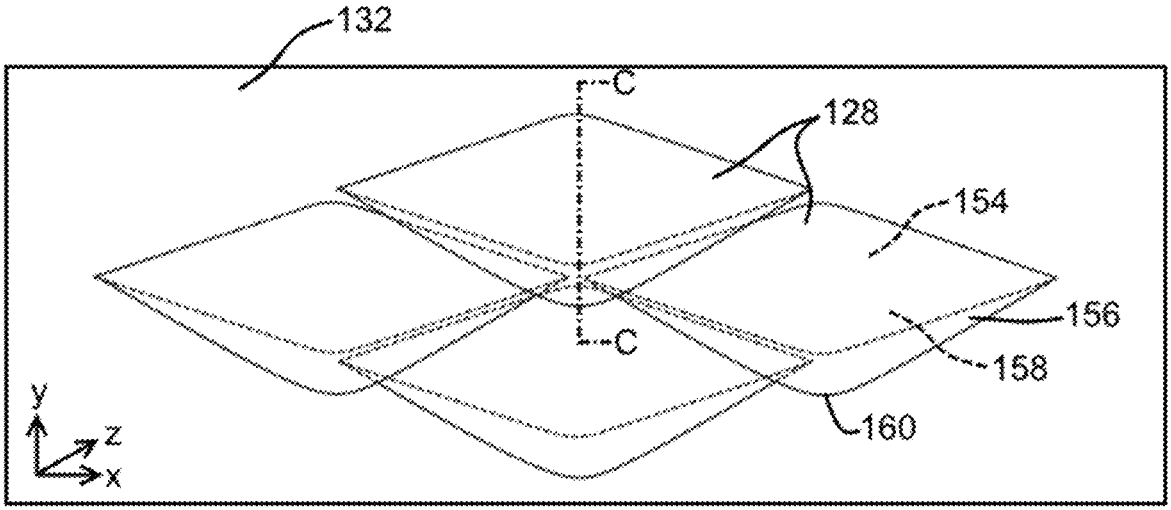
FIG. 4B
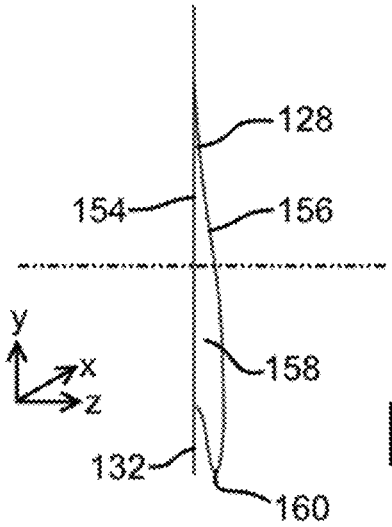
FIG. 4C

KNITTED ARTICLE WITH AT LEAST ONE SCALLOP ELEMENT AND METHODS OF MANUFACTURE

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed from a textile is an upper for an article of footwear.

Conventional articles of footwear generally include two primary elements: an upper and a sole structure. The upper is secured to the sole structure and forms a void within the article of footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and forms a ground-engaging portion of the sole structure that is formed from a durable and wear-resistant material.

The upper of the article of footwear generally extends over the instep and toe areas of the foot, along the medial and lateral sides of the foot, and around the heel area of the foot. Access to the void on the interior of the upper is generally provided by an ankle opening in a heel area of the footwear. A lacing system is often incorporated into the upper to adjust the fit of the upper, thereby facilitating entry and removal of the foot from the void within the upper. The upper may include a tongue that extends under the lacing system to enhance adjustability of the footwear, and the upper may incorporate a heel counter to limit movement of the heel.

DESCRIPTION

In one aspect, the present disclosure relates to an article at least partially formed by a knitted component. In some embodiments, the article may include an upper for an article of footwear. The knitted component may include a seamless portion extending from a toe area, through a midfoot area, and to a heel area of the upper on at least one of a lateral and a medial side of the upper. A first course may at least partially form the knitted component, and the first course may extend from the heel area to the toe area of the upper.

The first course may include a continuous strand of yarn extending from the heel area to the toe area of the upper.

The knitted component may include a first edge and a second edge, where the first edge and the second edge are attached at a seam. The seam may be located on the lateral side of the upper if the seamless portion is located on the medial side of the upper, or the seam may be located on the medial side of the upper if the seamless portion is located on the lateral side of the upper.

The first course may at least partially form one of a first layer and a second layer of a scallop element of the knitted component. The first layer of the scallop element may form an inner surface of the upper at least partially defining a void, and the second layer of the scallop element may form an external surface of the upper. The first layer of the scallop element may include more courses than the second layer of the scallop element.

The scallop element may include a length along the first direction and a width along the second direction, where the length is greater than the width. In some embodiments, the length may be at least twice the width.

In another aspect, the present disclosure relates to a method for forming an upper for an article of footwear. The method may include knitting a knitted component on a knitting machine with a seamless portion extending from a toe area, through a midfoot area, and to a heel area of the knitted component. Knitting the knitted component may include moving a feeder through a single pass to form at least a portion of the heel area of the knitted component, at least a portion of the midfoot area of the knitted component, and at least a portion of the toe area of the knitted component.

The single pass may form a first course, and the first course may include a continuous strand of yarn extending from the heel area to the toe area of the upper.

The method may include attaching a first edge of the knitted component and a second edge of the knitted component at a seam after knitting the knitted component.

The pass may at least partially form one of a first layer and a second layer of a scallop element of the knitted component. The first layer of the scallop element may form an inner surface of the upper at least partially defining a void, and the second layer of the scallop element may form an external surface of the upper. The first layer of the scallop element may include more courses than the second layer of the scallop element. The method may include pressing the first layer of the scallop element toward the second layer of the scallop element and providing heat to the first layer of the scallop element.

The accompany drawings, which are incorporated herein and constitute part of this specification, and, together with the general description given above and the detailed description given below, serve to explain features of the present invention.

DESCRIPTION OF THE DRAWINGS

FIG. 2 shows the upper depicted in FIG. 1 in an unfolded state.

FIG. 2A shows the upper depicted in FIG. 2 when being manipulated to conform to the appropriate shape for use in the article of footwear of FIG. 1.

FIG. 3 shows the upper of FIG. 2 when being formed on a knitting machine.

FIG. 3A shows the upper of FIG. 3, where the upper includes a depicted first course.

FIG. 4A shows a close-up view of scallop elements in accordance with the present disclosure.

FIG. 4B shows the view of the scallop elements of FIG. 4A with hidden lines shown by broken lines.

FIG. 4C shows a section view of a scallop element about line C-C of FIG. 4B.

DETAILED DESCRIPTION

Figure 1:
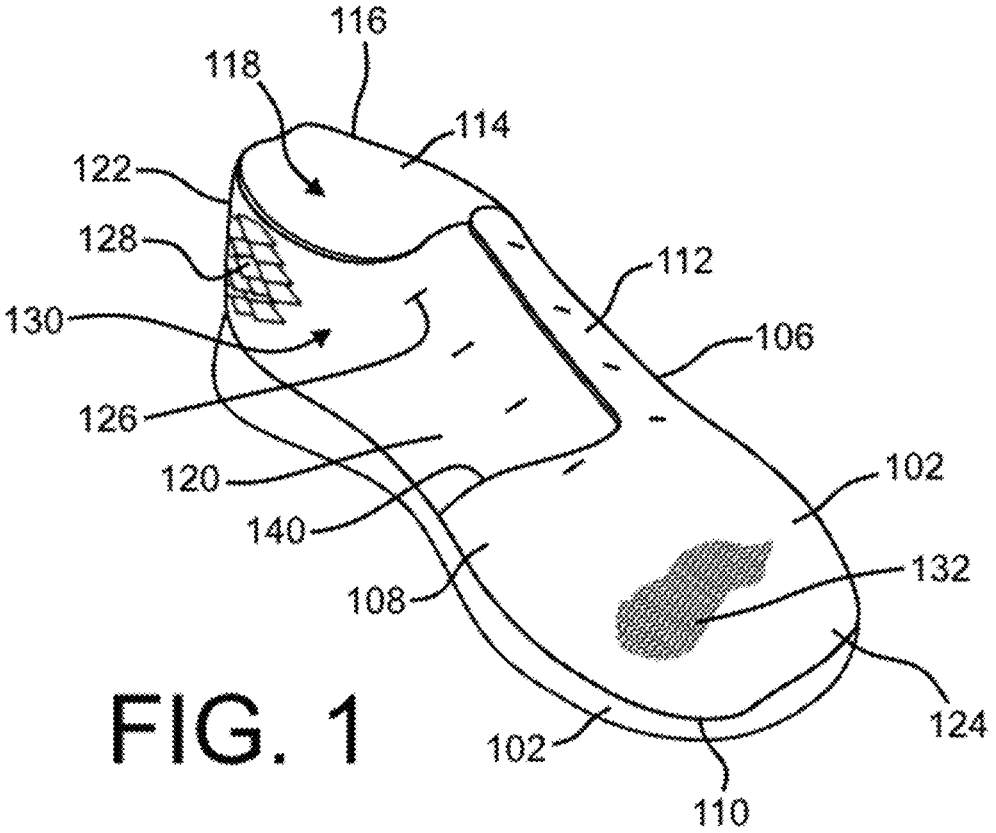
FIG. 1 shows an article of footwear with a knitted upper having a plurality of scallop elements in accordance with the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to articles at least partially formed from textiles. One example of an article is an article of apparel (e.g., shirts, pants, socks, footwear, jackets and other outerwear, briefs and other undergarments, hats and other headwear, or the like). The article may be an upper configured for use in an article of footwear. The upper may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The upper may also be incorporated into a non-athletic shoe, such as a dress shoe, a loafer, and a sandal.

Referring to FIG. 1, an article of footwear 100 may include an upper 102 secured to a sole structure 104. The upper 102 may include a lateral side 106 and a medial side 108. The area of the shoe where the sole structure 104 joins the upper 102 may be referred to as the biteline 110. The upper 102 may be joined to the sole structure 104 in a fixed manner using any suitable technique, such as through the use of an adhesive, by sewing, etc. It is contemplated that the upper 102 may extend partially or completely around the foot of a wearer and/or may be integral with the sole, and a sockliner may or may not be used. In some embodiments, the sole structure 104 may include a midsole (not shown) and an outsole.

The article of footwear 100 may additionally comprise a throat area 112 and an ankle opening 114, which may be surrounded by a collar 116 and may lead to a void 118. The void 118 of the article of footwear 100 may be configured to accommodate a foot of a person. The throat area 112 may be generally disposed in a midfoot area 120 of the upper 102. The midfoot area 120 is generally an area of the upper 102 located between a heel area 122 and a toe area 124. In some embodiments, a tongue may be disposed in the throat area 112, but a tongue is an optional component. The tongue may be any type of tongue, such as a gusseted tongue or a burrito tongue. If a tongue is not included, the lateral and medial sides of the throat area 112 may be joined together. As shown, in some embodiments, the article of footwear 100 may include an optional fastening element, such as a lace (which may be associated with the lace apertures 126). Any suitable type of fastening element may be used.

The article of footwear 100 may include one or more scallop elements 128. The scallop elements 128 may be arranged at any suitable location of the article of footwear, such as in the heel area 122 (as shown), the medial side 108, the lateral side 106, the toe area 124, and/or another location. The scallop elements 128 may be formed by two layers with a pocket therebetween (as described in more detail below) and may extend outward with respect to an outer surface 130 of the upper 102. The scallop elements 128 may be advantageous for providing the article of footwear 100 with suitable cushioning, rigidity (e.g., without sacrificing flexibility in certain directions), durability, desirable aesthetic properties, or other properties. Any suitable number of scallop elements 128 may be included. In some embodiments, about 1 to about 200 scallop elements may be included, such as about 5 to about 100 scallop elements, and more particularly about 15 to about 50 scallop elements in certain embodiments.

Referring to FIG. 2, at least a portion of the upper 102, and in some embodiments substantially the entirety of the upper 102, may be formed of a knitted component 132. FIG. 2 shows the upper 102 formed by the knitted component 132 as it may appear after a knitting process (such as a weft-knitting process on a flat knitting machine, for example). The knitted component 132 may additionally or alternatively form another element of the article of footwear, such as an underfoot portion, for example. The knitted component 132 may have a first side forming an inner surface of the upper 102 (e.g., facing the void of the article of footwear) and a second side forming an outer surface of the upper 102 (e.g. facing generally opposite the first side). The first side and the second side of the knitted component 132 may exhibit different characteristics (e.g., the first side may provide abrasion resistance and comfort while the second side may be relatively rigid and provide water resistance, among other advantageous characteristics mentioned herein). The knitted component 132 may be formed as an integral one-piece element during a knitting process, such as a weft knitting process (e.g., with a flat knitting machine or circular knitting machine), a warp knitting process, or any other suitable knitting process. That is, the knitting process on the knitting machine may substantially form the knit structure of the knitted component 132 without the need for significant post-knitting processes or steps. Alternatively, two or more portions of the knitted component 132 may be formed separately as distinct integral one-piece elements and then the respective elements attached.

Forming the upper 102 with the knitted component 132 may provide the upper 102 with advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. The knitted component 132 may also provide desirable aesthetic characteristics by incorporating yarns having different colors, textures or other visual properties arranged in a particular pattern. The yarns themselves and/or the knit structure formed by one or more of the yarns of the knitted component 132 may be varied at different locations such that the knitted component 132 has two or more portions with different properties (e.g., a portion forming the throat area 112 of the upper 102 may be relatively elastic while another portion may be relatively inelastic). In some embodiments, the knitted component 132 may incorporate one or more materials with properties that change in response to a stimulus (e.g., temperature, moisture, electrical current, magnetic field, or light). For example, the knitted component 132 may include yarns formed of a thermoplastic polymer material (e.g., polyurethanes, polyamides, polyolefins, and nylons) that transitions from a solid state to a softened or liquid state when subjected to certain temperatures at or above its melting point and then transitions back to the solid state when cooled. The thermoplastic polymer material may provide the ability to heat and then cool a portion of the knitted component 132 to thereby form an area of bonded or continuous material that exhibits certain advantageous properties including a relatively high degree of rigidity, strength, and water resistance, for example.

Referring to FIG. 2 and FIG. 2A, the knitted component 132 may include a seamless portion 134 extending from the toe area 124, through a midfoot area 120, and to a heel area 122 on at least one of a lateral side and a medial side of the upper (such as the lateral side 106 as depicted). In some embodiments, the knitted component 132 may include a first edge 136 and a second edge 138, which may be terminal ends of the knitted component 132 after the knitting process when the knitted component 132 is removed from the knitting machine. As illustrated in FIG. 2A, after the knitting process, the knitted component 132 may be folded or otherwise manipulated such that a first edge 136 and the second edge 138 are secured together at a seam 140 (shown in FIG. 1) during formation of the upper 102. The seam 140 (see FIG. 1) may be located on the lateral side 106 of the upper 102, on the medial side 108 of the upper 102, and/or in another location (e.g., at the back of the heel area 122 of the upper). Forming the upper 102 such that it is in an appropriate shape for inclusion in an article of footwear may further include lasting the upper 102. An example of a lasting process is described in U.S. patent application Ser. No. 12/848,352, filed Aug. 2, 2010, and issued as U.S. Pat. No. 8,595,878, which is herein incorporated by reference in its entirety.

Referring to FIG. 3 and FIG. 3A, when forming the knitted component 132, the knitted component 132 may be oriented with respect to a needle bed 144 of a knitting machine 146 such that a feeder 148 of the knitting machine 146 is capable of moving in a single pass (i.e., without changing its feed direction direction) to knit a first course 150 from the toe area 124 of the knitted component 132, through the midfoot area 120 of the knitted component 132, and to the heel area 122 of the knitted component 132 (and/or vice versa). Thus, as shown in FIG. 3A, when the knitted component 132 is formed and removed from the knitting machine, the first course 150 (which may include one or more yarns dispensed from the feeder 148 during the single pass) may extend at least from the toe area 124 to the midfoot area 120 and/or at least from the midfoot area 120 to the heel area 122, and potentially from the heel area 122 all the way to the toe area 124.

In some embodiments, the first course 150 may include a continuous strand of yarn 152 that extends from the heel area 122 to the toe area 124 of the upper 102. Additionally or alternatively, one or more strands of yarn forming at least a portion of the first course 150 may extend less than the full length of the first course 150. For example, it is contemplated that a strand of yarn may extend from the heel area 122 to the midfoot area 120 but may terminate within the first course 150 prior to reaching the toe area 124. Similarly, it is contemplated that a strand of yarn may extend within the first course 150 from the midfoot area 120 to the toe area 124, but may terminate prior to reaching the heel area 122. As shown in FIG. 3A (and FIG. 5), the first course 150 may at least partially form the scallop elements 128 of the knitted component 132 and/or portions of the knitted component 132 without scallop elements.

FIG. 4A shows a close-up view of four scallop elements 128 of the knitted component 132, and FIG. 4B shows the knitted component 132 with the scallop elements 128 of FIG. 4B depicted with hidden elements shown in broken lines. FIG. 4C shows a side sectional view of a scallop element 128 about line C-C of FIG. 4B. As shown best by FIG. 4B and FIG. 4C, each scallop element 128 may have a first layer 154, a second layer 156, and a pocket 158 between the first layer 154 and the second layer 156. The pocket 158 may be filled with another element (e.g., a filler material, such as foam, down, or another suitable material or object), but this is not required, and in exemplary embodiments, the pocket 158 may be empty and/or filled with just air. The first layer 154 and the second layer 156 may both be formed by knit structures of the knitted component 132 such that the scallop element 128 is primarily formed on a knitting machine with the rest of the knitted component 132. In some embodiments, the above-described first course 150 (described above and shown in FIG. 3 and FIG. 3A) may form at least one of the first layer 154 and the second layer 156 of the scallop element 128. The second layer 156 shown in FIG. 4C may have more courses, and thus more knitted material, than the first layer 154 at a particular cross section (e.g., the cross-section depicted in FIG. 4C). As a result, when the first layer 154 is taught (as shown), the second layer 156 may have some slack such that it sags or otherwise extends away from the first layer 154.

The second layer 156 may be configured such that an apex 160 (defined as an extreme or terminal peak) is configured to slant in a particular direction. For example, if the yarns forming the second layer 156 are relatively compliant, the second layer 156 may droop due to gravitational pull or otherwise slant such that the apex 160 is offset with respect to the centerline of the scallop element 128 depicted in FIG. 4C. In some embodiments (and referring to the y-axis of FIG. 4C), the apex 160 may extend to a location on the y-axis that is beyond the y-axis terminus of the first layer 154. Further, it is contemplated that the second layer 156 may be manipulated during manufacturing of the knitted component 132 (e.g., during post-knitting process, such as a vacuum and/or heating process as described below) such that the apex 160 is positioned in, and remains in (or at least has a tendency to remain in), the slanted position.

As best shown in FIG. 4A and FIG. 4B, an apex 160 of one or more scallop elements 128 may overlap at least one other scallop element 128 such that a portion of the second layer 156 of the overlapped scallop element 128 is not visible (at least from a front perspective depicted in FIG. 4A). The scallop elements 128 may move during article use, which may cause the coverage of one scallop element 128 over another to change, thereby providing a dynamic visual effect. Also, advantageously, by providing dynamic/movable overlapping coverage, flexing and/or stretching of the knitted component 132 may occur without substantially changing the orientation or damaging the second layer 156 of the scallop elements 128. It is contemplated, for example, that the taught first layer 154 may be configured (e.g., formed with a particular material) such that it provides suitable stretchability, strength, durability, and/or other characteristics, particularly in the direction of the depicted y-axis, without substantial help from the second layer 156. The second layer 156 may also be rigid to form armor for protection of a foot within the article of footwear, for example. Further, in some embodiments it is contemplated that the first layer 154 may be capable of stretching in response to an input force to an extent that the second layer 156 becomes taught. In such embodiments, the second layer 156 may be formed of a relatively rigid material such that it provides lockdown (e.g., prevents further stretching) once the second layer 156 becomes taught, which may be advantageous when it is desirable for the knitted component to stretch/displace to a certain extend and then abruptly stop when it reaches a certain point. Thus, it is contemplated that the first layer 154 may have an elasticity that is greater than an elasticity of the second layer 156, but this is not required in all embodiments.

When the knitted component 132 is included in an upper, the second layer 156 of the scallop elements 128 may form an external surface of an upper (depicted in FIG. 1), and the first layer 154 of the scallop element 128 may form an inner surface of the upper. Advantageously, the scallop elements 128 may provide beneficial characteristics to the upper without sacrificing comfort-related surface characteristics within the upper's void. In other embodiments, the scallop elements 128 may be located inside the void, which may be advantageous when the scallop elements 128 are configured for comfort within the void (for example, when the scallop elements 128 are constructed to provide cushioning and/or include an additional cushioning element within their respective pockets).

Figure 5:
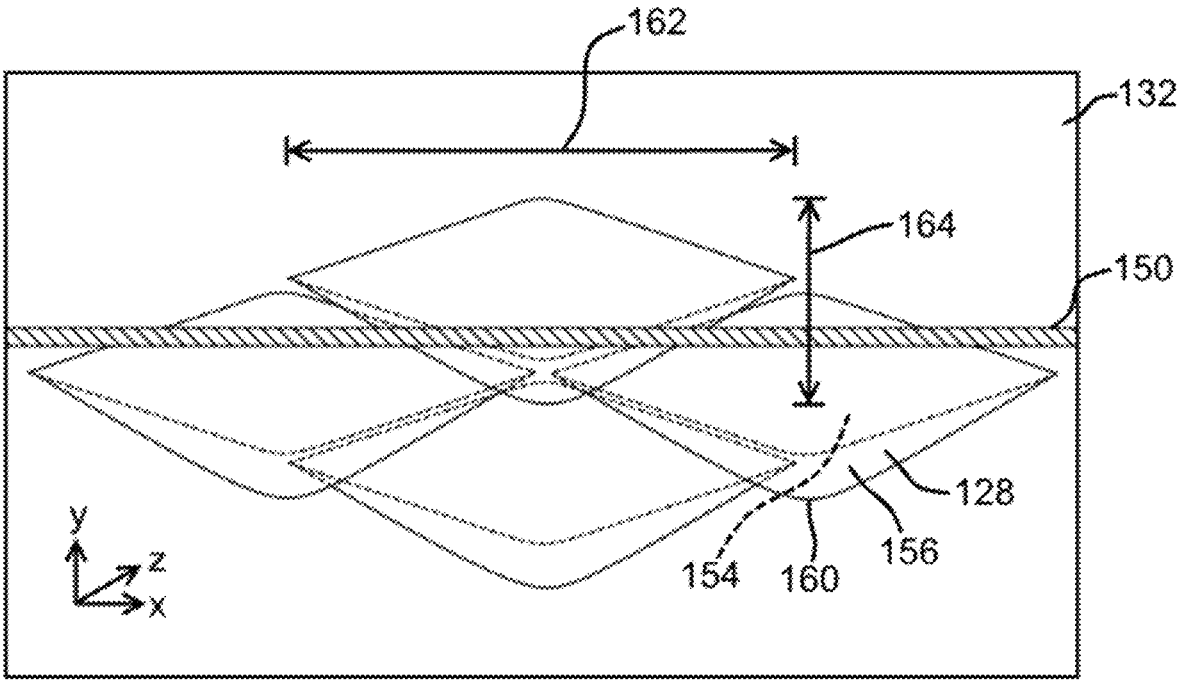
FIG. 5 shows the scallop elements of FIG. 4A and FIG. 4B including a first course.

As shown in FIG. 5, the first course 150 (described in detail above with reference to FIG. 3 and FIG. 3A) may at least partially form a layer (i.e., the first layer 154 and/or the second layer 156) of one or more of the scallop elements 128. The first course 150 may extend along a direction that herein defines "a first direction" (which is illustrated as along the x-axis in FIG. 5). The first direction may be approximately horizontal when the knitted component 132 is incorporated into an upper, for example, and/or when the knitted component 132 is being formed on a knitting machine (such that the "first direction" is parallel to the needle bed). The apex 160 of at least one scallop element 128 may slant in a second direction, which may be perpendicular to the first direction (e.g., such as towards the ground in the vertical direction along the y-axis). In other embodiments, certain scallop elements 128 may have one or more apices 160 that slant in respective different directions.

A scallop element 128 may include a length 162 along the first direction and a width 164 along the second direction. The length 162 may be larger than the width 164, for example. The larger length 162 may provide the scallop element 128 with suitable dimensions such that the apex 160 is configured to slant in the second direction (perpendicular the length). For example, providing the scallop element 128 with a high length-to-width ratio may simplify the knitting process of the scallop element 128 when it is desired for the scallop element 128 to have an apex 160 slanting in the second direction. It is contemplated that, with a high length-to-width ratio, the scallop element 128 can be given appropriate characteristics for forming a suitable apex by knitting with an ottoman knit structure, where the second layer 156 includes more courses/passes than the first layer 154. In some embodiments, the length 162 of the scallop element 128 may be at least 25% larger than the width 164, at least 50% larger than the width 164, at least twice the width 164, at least five times the width 164, or greater than five times the width 164. In one non-limiting exemplary embodiment, the length 162 of the scallop element 128 may be about twice the width 164. The length of scallop elements 128 on a single article can vary, or each scallop element 128 on a single article can have the same length. In some embodiments, the length 162 of a scallop element 128 may be about 0.25 cm to about 5 cm, such as about 0.75 cm to about 3 cm.

Figure 6:
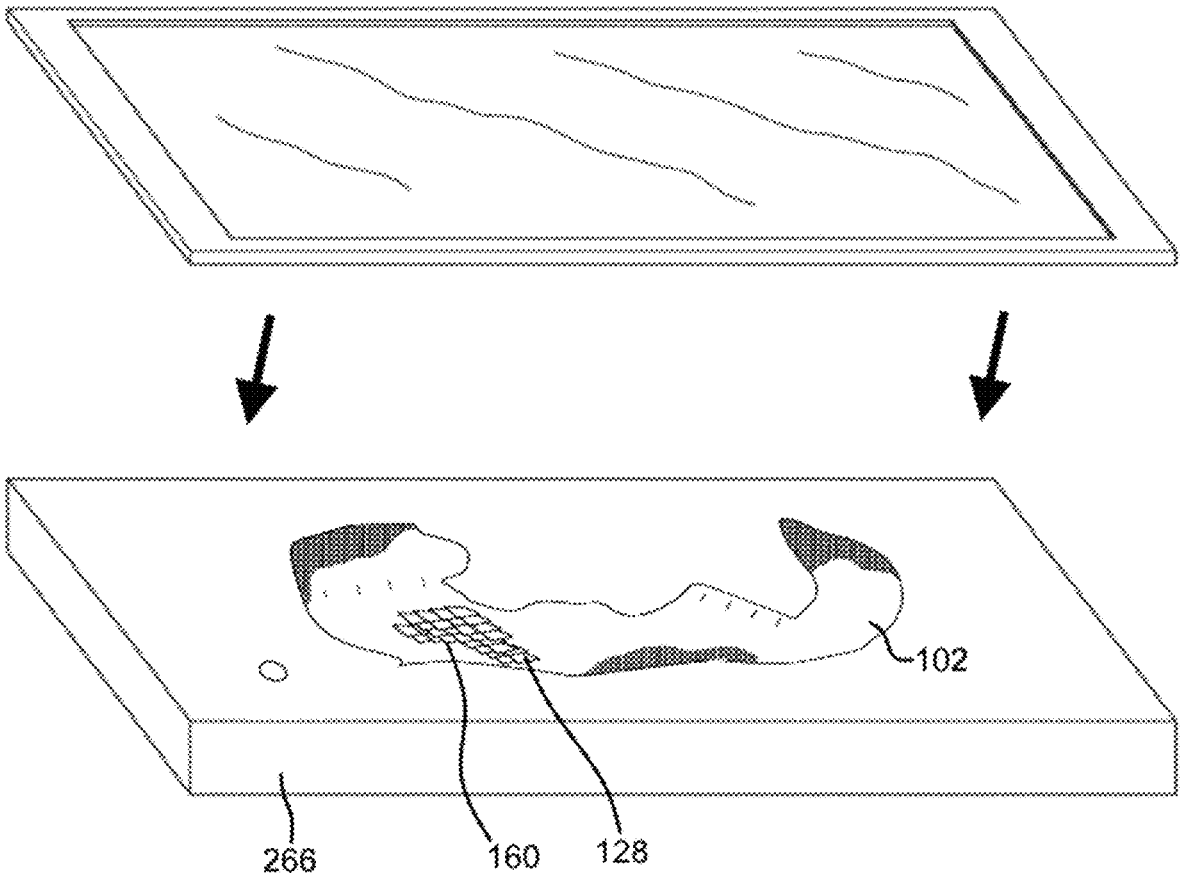
FIG. 6 shows the upper depicted in FIG. 2-FIG. 3A being processed in a vacuum press.

A variety of processes are contemplated for manipulating the scallop elements 128, and these processes may occur during or after the knitting process for forming the knitted component 132. For example, referring to FIG. 6, the upper 102 with the knit scallop elements 128 may be placed in a vacuum press 266 after the knitting process. Before or during placement in the vacuum press 266, the apices 160 of the scallop elements 128 may be situated in a desired orientation, such as offset with respect to the center of the scallop element 128, by any suitable process (e.g., by hand, by blowing gas (air) or liquid, by vacuuming, or the like). Then, the vacuum press 266 may seal around the knitted component and provide force to press the layers of the scallop elements 128 towards each other. During or after the vacuuming process, heat may be applied to the scallop elements 128 by a steam-providing device, for example, which may activate thermoplastic polymer materials in the yarns forming the scallop elements 128. Once this heat is removed and the article cools, the thermoplastic materials of the scallop elements 128 may at least partially fuse together when they transition to a solid state, which may cause the scallop elements 128 to remain fixed in (or at least have a tendency to remain fixed in) a desirable position and orientation.

While the embodiments of the scallop elements 128 and other features are described generally herein with reference to an upper for an article of footwear, those features could additionally or alternatively be incorporated into another type of article. For example, knitted scallop elements may be included in articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats).

In the present disclosure, the ranges given either in absolute terms or in approximate terms are intended to encompass both, and any definitions used herein are intended to be clarifying and not limiting. Notwithstanding that the numerical ranges and parameters setting forth the broad scope of the present embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the present disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the present disclosure and without diminishing its intended advantages. It is therefore intended that such changes and modifications be covered by the appended claims.

We claim:

1. A knitted component for an upper of an article of footwear, the knitted component comprising:

a first scallop element having a first layer, second layer, and a pocket between the first layer and the second layer; and a first course forming at least one of the first layer and the second layer of the first scallop element, the first course extending in a first direction, wherein the second layer includes more courses than the first layer such that the second layer sags, wherein an apex of the second layer slants is offset from a centerline of the first scallop element, and wherein the first scallop element is arranged to overlap at least a portion of a second scallop element and at least a portion of a third scallop element, with the second scallop element located on a first side of a centerline of the first scallop element and the third scallop element located on a second side of the centerline of the first scallop element.

2. The knitted component of claim 1, wherein the first scallop element includes a length along the first direction and a width along a second direction, wherein the length is greater than the width.

3. The knitted component of claim 2, wherein the length is at least twice the width.

4. The knitted component of claim 1, wherein the knitted component is configured to form an upper for an article of footwear, and wherein the first course is configured to extend from a heel area of the upper, through a midfoot area of the upper, and to a toe area of the upper.

5. The knitted component of claim 1, wherein the knitted component is configured to form an upper for an article of footwear, and wherein the second layer is configured to form an external surface of the upper.

6. A knitted component for an upper of an article of footwear, the knitted component comprising:

a first scallop element and a second scallop element located adjacent to the first scallop element, wherein each of the first scallop element and the second scallop element are formed by a first knit layer and a second knit layer, the respective second knit layers having more knit courses than the first knit layers and wherein the second knit layers droop, and wherein the first scallop element is arranged to at least partially overlap the second scallop element and a third scallop element, with the second scallop element located on a first side of a centerline of the first scallop element and the third scallop element located on a second side of the centerline of the first scallop element.

7. The knitted component of claim 6, wherein the apex of the first scallop element is offset from the centerline of the first scallop element.

8. The knitted component of claim 7, wherein the first scallop element includes a length along a first direction and a width along a second direction, wherein the length is greater than the width.

9. The knitted component of claim 6, wherein the knitted component forms an upper for an article of footwear, and wherein a first course is configured to extend from a heel area of the upper, through a midfoot area of the upper, and to a toe area of the upper.

10. The knitted component of claim 6, wherein the knitted component forms an upper for an article of footwear, and wherein the second knit layer of the first scallop element forms an external surface of the upper.

11. The knitted component of claim 6, wherein the portion of the first scallop element overlaps a portion of the knitted component beyond a boundary where the first knit layer of the first scallop element and the second knit layer of the first scallop element are connected.

12. A knitted component for an upper of an article of footwear, the knitted component comprising:

a first scallop element having a first layer, second layer, and a pocket between the first layer and the second layer; and wherein the second layer includes a fusible material that secures a terminal apex of the second layer such that the terminal apex is offset from a centerline of the first scallop element and the second layer sags, and wherein the first scallop element is arranged to at least partially overlap at least two additional scallop elements, with at least one additional scallop element on each side of a centerline of the first scallop element.

13. The knitted component of claim 12, wherein the fusible material is included with a yarn that is included in a course of the second layer.

14. The knitted component of claim 12, wherein the fusible material is excluded from the first layer.

* * * * *